United States Patent [19]

Stephens et al.

[11] 4,063,719

[45] Dec. 20, 1977

[54] HEAT TREATMENT APPARATUS

[75] Inventors: William W. Stephens, Albany, Oreg.; James F. McKeighen, Huntington Beach, Calif.

[73] Assignee: Kawecki Berylco Industries, Inc., Reading, Pa.

[21] Appl. No.: 664,576

[22] Filed: Mar. 8, 1976

[51] Int. Cl.[2] ..... C21D 1/62

[52] U.S. Cl. ..... 266/130; 134/165; 193/34; 266/132

[58] Field of Search ..... 193/34; 134/165; 266/114, 130, 132

[56] References Cited

U.S. PATENT DOCUMENTS

| | | | |
|---|---|---|---|
| 1,376,106 | 4/1921 | MacDonald | 266/130 X |
| 1,414,366 | 5/1922 | MacDonald | 266/128 X |
| 1,936,719 | 11/1933 | Knerr | 266/271 X |
| 2,905,797 | 9/1959 | Guyer et al. | 266/130 X |

*Primary Examiner*—Roy Lake
*Assistant Examiner*—Paul A. Bell
*Attorney, Agent, or Firm*—Kolisch, Hartwell, Dickinson & Stuart

[57] ABSTRACT

An apparatus for heat treating elongate articles including a furnace arranged above a quenching liquid reservoir and guide elements for guiding heated elongate articles from the furnace into the quenching liquid. In a preferred embodiment, the furnace utilizes a plurality of elongate tubes which receive detachably held elongate articles. Upon release, the elongate articles fall while oriented vertically by the guide elements into the quenching liquid. Warping or bending of the elongate articles is thereby prevented during the transfer from the furnace to the quenching liquid.

9 Claims, 2 Drawing Figures

HEAT TREATMENT APPARATUS

The present invention relates to the heat treatment of metal articles, and more particularly to apparatus for the heat treatment of metal articles where the treatment comprises an initial heating period at an elevated temperature of an article with such being followed by a rapid cooling or quenching of said article.

The heat treatment of a metal article by heating the article at a high temperature and then rapidly cooling it is a process commonly applied to a metal article to change the physical or metallurgical properties thereof. For instance, the process may be applied to an article in an annealed or partially annealed state to increase the hardness of the article. In a heat treatment which relies on rapid quenching or cooling after the heating cycle, obviously optimum results are obtained if transfer from the heating zone to the quenching zone occurs as rapidly as possible. An additional consideration, especially important when an elongated article such as shaft or tube is being processed, is that the article move into the quenching liquid in such a manner that the rapid cooling produced by the quenching will not warp or otherwise deform the article. Further explaining, if an elongated article such as a piece of tubing is quenched in such a manner that regions along one side are cooled slightly ahead of regions on the other, such will cause an instantaneous preliminary contraction on the one side and a permanent bend being imparted to the shaft or tube necessitating further complicating processing in the article if such is to be returned to a straightened form.

Another difficulty encountered in heat treatment is occasioned by the fact that many times the temperature employed during the heating is close to the melting point of the metal involved, with the metal, as a consequence, becoming extremely ductile. As a consequence, it is important that when an article such as a shaft or tube is subjected to heat, it be supported in the furnace in such a manner that the mass of the article itself will not cause the same to become deformed.

Heat treatment apparatus has been proposed in the past, which includes a furnace, a container for a quenching liquid, and means for transferring an article from the furnace to the liquid in such container. However, apparatus known to date has generally been rather complicated in construction and relied upon mechanical conveying devices for effectuating transfer from the furnace to the quenching liquid. Such can be quite complicated and expensive, particularly if designed to convey a multiplicity of articles from the furnace to quenching zone at the same time. Furthermore, any conveying system has limitations with respect to the speed with which the transfer takes place.

Generally, an object of this invention, therefore, is to provide improved apparatus for the heat treatment of articles where such apparatus includes a furnace and a reservoir for containing a quenching liquid, characterized by a construction wherein the articles are permitted to fall by gravity from the furnace into the quenching liquid with such articles during such falling being guided whereby they enter the quenching liquid having a predetermined orientation.

More specifically, the invention concerns apparatus for the heat treatment of elongated articles like shafts or tubes wherein the articles, after being heated in the furnace, are released from the furnace, thence to be conducted while oriented vertically in a free fall path which extends into quenching liquid contained by a reservoir disposed below the furnace. Guide elements extend between the furnace and the reservoir holding the quenching liquid, which operate to maintain proper orientation of the articles as they fall into the quenching liquid.

It is preferred and contemplated by another object of the invention that an ambient air circulating zone be provided between the reservoir, and the furnace which is superimposed thereover. In this way, any steam or other vapor produced on heated articles falling into the quenching liquid tends on passing upwardly to be diffused into the ambient air rather than be channeled into the interior of the furnace.

A further object is to provide a furnace and guide means for conducting articles heated in the furnace downwardly into a quenching zone, where the furnace comprises multiple tubes, each adapted to confine an article during the heating thereof, and wherein the guide means comprises another set of tubes, each registering with respective tubes in the furnace, and operating to receive articles dropping from the tubes of the furnace and to guide them as they fall downwardly into the quenching liquid.

Another object of the invention is to provide a novel means for suspending articles in a furnace, tending to inhibit distortion in the article during the heating process.

These and other objects and advantages are attained by the invention, which is described hereinbelow in conjunction with the accompanying drawings, wherein:

FIG. 1 is a side view, partially broken away, of heat treating apparatus in accordance with the present invention, illustrating an elevated furnace means, guide elements disposed below the furnace means, and at the base of the apparatus a reservoir for holding quenching liquid; and FIG. 2 is a view, somewhat enlarged, taken along lines 2—2 in FIG. 1.

DETAILED DESCRIPTION OF THE INVENTION

Figure 1:
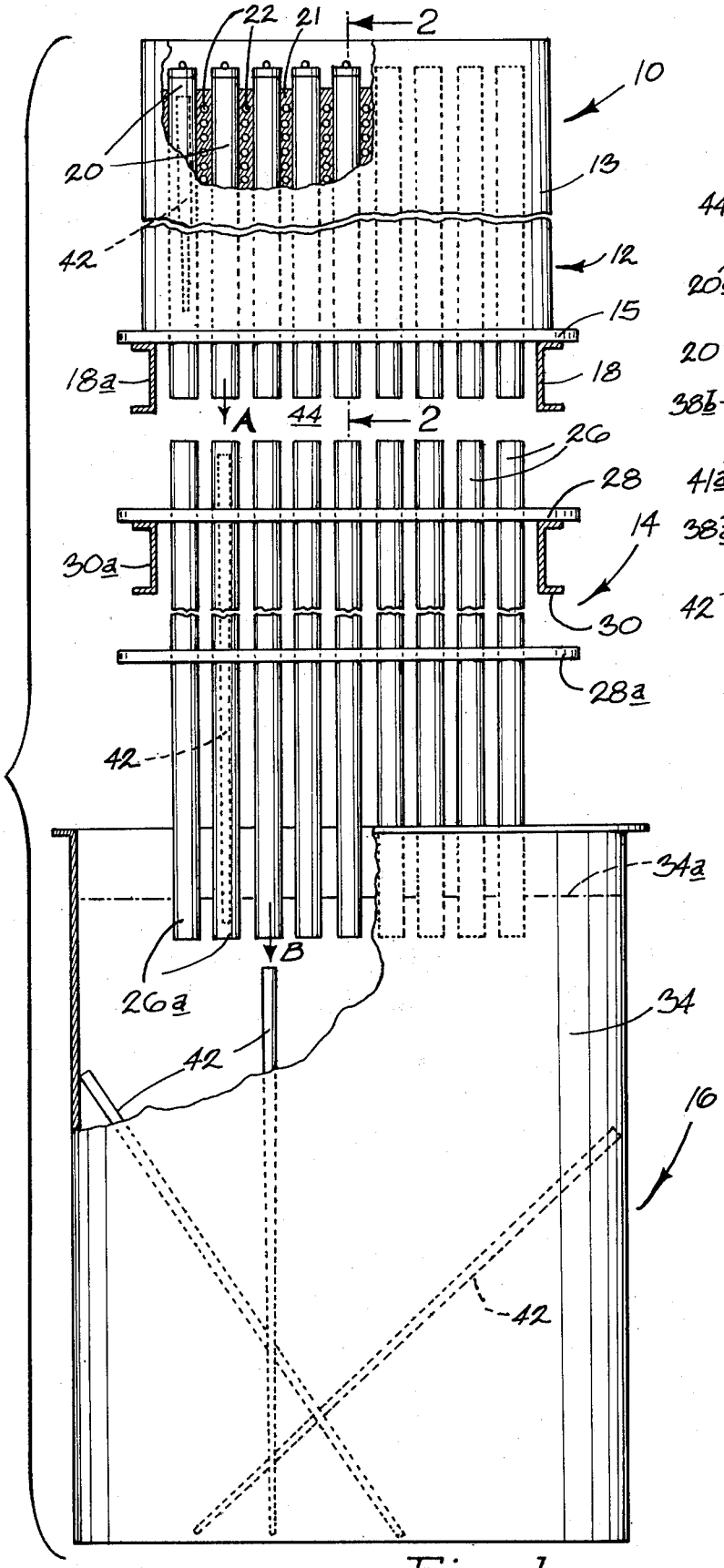

Turning now to the drawings, and referring initially to FIG. 1, a heat treating apparatus in accordance with the present invention is generally designated at 10. Heat treating apparatus 10 comprises three main sections, namely, furnace means 12, guide means or structure 14, and quenching liquid reservoir 16.

Furnace means 12 includes an outer cylindrical casing or covering 13 and a base 15. Base 15 is supported upon members 18 and **18*a* (shown in cross section) which are in turn connected to an outer framework (not shown). Arranged within furnace means 12 are a plurality of elongated vertically disposed tubes 20. Tubes 20 are appropriately spaced from each other within the casing and are positioned by base 15. Heating elements 22, which may be electric, are provided about tubes 20 in order to heat same. For reasons of simplicity, the heating elements 22 are shown schematically. Insulation 21 may be provided about the outside of tubes 20 and the inside of cover 13**.

Guide structure 14 is disposed beneath furnace means 12. Guide structure 14 includes a plurality of guide elements or second, elongate tubes 26 which are supported and oriented in spaced-apart relationship in a base plate 28. Base plate 28 is, in turn, supported upon members 30 and **30*a*** (shown in cross section). Members 30 and 30*a* are also connected to a framework for supporting the guide structure 14 above quenching liquid reservoir or tank 32. A second plate 28*a* may be provided for permitting the tubes 26 to be inserted therethrough for additional support and alignment of tubes 26. It can be seen from a viewing of FIG. 1 that each of the second, elongate tubes 26 is disposed directly beneath an associated one of the first, elongate tubes 22, in a position aligned or registering therewith.

Quenching liquid reservoir 16 is filled with a quenching liquid 34 to a level as shown at 34*a*. Level 34*a* is usually somewhat above the bottom ends of elongate tubes 26. Quenching liquid reservoir 16 may be constructed as a tank as shown in FIG. 1.

Figure 2:
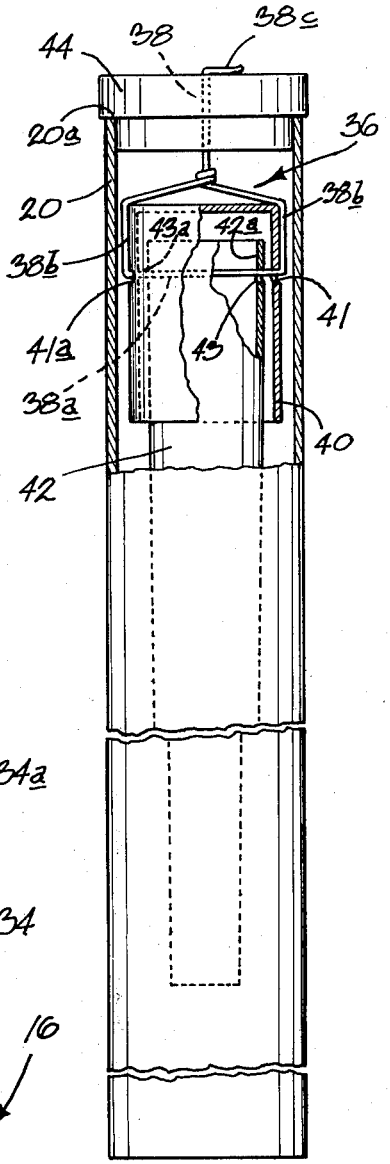

With reference directed now to FIG. 2, an organization for detachably suspending an elongate article within each of the elongate tubes 22 is generally designated at 36. Organization 36 includes a hanger or wire 38 and a sleeve 40 which fits within a tube 22. Sleeve 40 has opposed apertures 41 and 41*a*. An elongate article to be heat treated, exemplified by elongate hollow shaft 42 shown in FIG. 2, also includes opposed apertures 43 and 43*a* in opposite sides thereof. Hanger 38 has a segment or portion 38*a* inserted through apertures 41, 43 and 41*a*, 43*a*. Hanger 38 also includes segments 38*b* extending upwardly alongside sleeve 40, and the top end of the hanger passes through an aperture in cap 44. Cap 44 substantially sealingly engages upper end 20*a* of an elongate tube 20 to prevent heat loss therefrom. Bent over portion 38*c* of the hanger prevents the hanger from falling through the aperture provided in cap 44.

It may be appreciated that as the result of gravity pulling down on shaft 42, hanger segments 38*b* exert inwardly directed squeezing forces on sleeve 40. The sleeve, however, isolates these forces whereby they are prevented from being exerted on upper wall portion 42*a* of elongate tube 42. Thus, upper wall portion 42*a* will not be subjected to deformation during a heating operation. Preventing distortion in upper portion 42*a* of elongate article 42 is important where the article desirability is maintained with a predetermined shape.

A heat treating sequence utilizing heat treating apparatus 10 of the present invention will now be described. A plurality of elongate articles are initially suspended within elongate tubes 20 in the manner described with reference to shaft 42 illustrated in FIG. 2. The elongate articles 42, upon being heated in the furnace for a predetermined time, are released from their detachably suspended positions within tubes 20, as by severing hanger wire segment 38*c*. The articles 42 then fall, under the influence of gravity, and in the direction of arrow A, downwardly from the tubes 20 into the lower set of tubes 26. It may be appreciated that the tubes 20, 26 orient the articles 42 with their axes substantially vertical while conducting the articles in a substantially vertical free-fall path downwardly into quenching liquid 34.

As can be seen in FIG. 1, the bottom ends 26*a* of tubes 26 preferably are disposed beneath top level 34*a* of the quenching liquid. The articles travel into the quenching liquid, which may be water, while traveling vertically downwardly, as indicated by the arrow B. Moving into the quenching liquid, the articles are rapidly cooled to effect the quenching process.

It will be noted that the bottom of reservoir 16 is a substantial distance below the bottom ends 26*a* of tubes 26. As a consequence, when articles 42 have traveled so that their bottom ends move against the bottom of the reservoir, their top ends move free of the bottom ends of tubes 26. Top extremities of the articles tend to shift laterally in the reservoir until they come up against the sides of the reservoir. In this position they are easily extracted with their being moved upwardly along the sides of the reservoir.

It will be noted that the upper ends of tubes 26 are spaced a slight distance below the bottom ends of the tubes 20 in the furnace means. In this way, an ambient air circulating zone is provided where ambient air is permitted to circulate laterally across the open bottom ends of the tubes in the furnace means. As a consequence, any vapor produced when the heated articles enter the quenching liquid tends not to be channeled upwardly and directly into the bottom ends of the tubes of the furnace means. This is important in obtaining optimum efficiency in the furnace, and in the case of certain types of materials, in inhibiting contamination of the articles being processed during the heating of such articles.

It should be apparent from the above description that the heat treating apparatus described enables elongated articles such as elongated rods, shafts, tubes and the like, to be heat treated by heating and then rapidly quenching the articles, with a relatively simple means provided for transferring the articles rapidly into the quenching liquid at the conclusion of the heating cycle. The articles are transferred into the quenching liquid without relying upon a mechanical conveying system, but instead permitting them to fall under the influence of gravity directly into the quenching liquid. During such fall, the articles are oriented in a vertical position, so that upon entering the quenching liquid, deformation and distortion in the article occasioned by one side of the article being rapidly cooled slightly in advance of the other, is inhibited.

While the invention has been particularly shown and described with reference to the foregoing preferred embodiment, it will be understood by those skilled in the art that other changes in form and detail may be made therein without departing from the spirit and scope of the invention as defined in the apended claims. 9n

What is claimed is:

1. An apparatus for heat treating an elongate article comprising:

reservoir means for holding a quenching liquid;

furnace means disposed above said reservoir means for applying heat to the article with the article releasably held therewithin; and guide means disposed between said furnace means and said reservoir means for orienting the article with its axis substantially vertical while conducting the article in a substantially vertical free-fall path extending into said quenching liquid upon release of said article from said furnace means.

2. An apparatus for heat treating an elongate article comprising:

reservoir means for holding a quenching liquid;

furnace means disposed above said reservoir means for applying heat to the article, said furnace means including means defining a chamber loosely receiving the article and including means for releasably holding the article within said chamber;

an ambient air circulating zone defined between said reservoir means and said furnace means; and guide means disposed between said furnace means and said reservoir means operable to orient an article in a position where its axis is substantially vertical while conducting the article during free fall in a substantially vertical path extending from said furnace means through said zone and into said quenching liquid.

3. An apparatus for heat treating elongate articles comprising:

reservoir means for holding a quenching liquid;

furnace means having a plurality of first tubes disposed above said reservoir means, said tubes defining chambers adapted loosely to receive articles; and a plurality of second tubes disposed between said furnace means and said reservoir means registering with respective ones of said first tubes for guiding articles dropping from said first tubes into quenching liquid held by said reservoir means, said second tubes orienting articles whereby their axes are substantially verticle on dropping through the second tube into quenching liquid held by said reservoir means.

4. An apparatus for heat treating an elongate article comprising:

reservoir means for holding a quenching liquid;

furnace means disposed above said reservoir means for applying heat to the article, said furnace means including means defining a chamber loosely receiving the article and including means for releasably holding the article within said chamber; and guide means disposed between said furnace means and said reservoir means operable to orient the article in a position where its axis is substantially vertical while conducting the article during free fall in a substantially vertical path extending into such quenching liquid upon release of said article from said furnace means.

5. An apparatus as defined in claim 4, wherein said furnace means includes a plurality of first, elongate elements, each defining a chamber adapted loosely to receive an article and each operable to orient an article in said furnace means with the axis of such article substantially vertical, and wherein said guide means includes a plurality of second, elongate elements, each of which is disposed beneath an associated one of said first elongate elements and each of which guides an article in a substantially vertical path.

6. An apparatus as defined in claim 4, wherein said furnace means includes a plurality of first, elongate tubes disposed vertically in said furnace means, each defining a chamber adapted loosely to receive an article and each adapted to receive an article therewithin with the axis of the article oriented substantially vertically, and wherein said guide means includes a plurality of second, elongate tubes, each of which is disposed beneath an associated one of said first, elongate tubes, and each of which is adapted to receive an article dropping from the tube disposed thereabove and then to conduct such article into said quenching liquid.

7. An apparatus as defined in claim 6, wherein the second, elongate tubes have upper ends spaced below the bottom ens of associated first elongate tubes to define an ambient air space therebetween;

said second, elongate tubes having lower ends at least adjacent quenching fluid in said reservoir means;

said ambient air space accommodating the escape of vapor channeled upwardly through a second, elongate tube from said quenching liquid.

8. An apparatus as defined in claim 7, wherein said second elongate tubes have bottom ends disposed substantially above the bottom of said reservoir means, to permit articles to pass beyond said bottom ends on entering the reservoir means.

9. An apparatus as defined in claim 4, wherein the means for releasably holding an article comprises:

a cap configured to substantially sealingly engage a top end of a first, elongate tube;

a sleeve fitting within the first elongate tube receiving over the upper end portion of an elongate article, said sleeve having opposed apertures in opposite sides thereof; and hanger means releasably connected to said cap, said hanger means also passing through said apertures to hold the sleeve and including a portion within the sleeve suspending an elongate article from said sleeve.

* * * * *